United States Patent [19]

Beiswenger

[11] Patent Number: 4,635,171

[45] Date of Patent: Jan. 6, 1987

[54] COMPACT ELECTRIC LIGHT

[75] Inventor: John L. Beiswenger, Salem, Wis.

[73] Assignee: Rayovac Corporation, Madison, Wis.

[21] Appl. No.: 798,991

[22] Filed: Nov. 18, 1985

[51] Int. Cl.[4] ..... F21L 7/00

[52] U.S. Cl. ..... 362/187; 362/304; 362/200; 362/308

[58] Field of Search ..... 362/187, 200, 308, 309, 362/307, 341, 346, 328, 329, 326, 304, 305

[56] References Cited

U.S. PATENT DOCUMENTS

| | | | |
|---|---|---|---|
| 2,072,849 | 3/1937 | Dietrich | 362/329 |
| 2,338,078 | 12/1943 | Wood | 362/187 |
| 3,395,272 | 7/1968 | Nicholl | 362/305 |
| 4,423,473 | 12/1983 | Kirkley | 362/190 |
| 4,432,041 | 2/1984 | Pfisterer et al. | 362/86 |
| 4,504,889 | 3/1985 | Goldfarb | 362/200 |
| 4,506,314 | 3/1985 | Moore | 362/328 |
| 4,530,040 | 7/1985 | Petterson | 362/328 |

*Primary Examiner*—E. Rollins Cross
*Attorney, Agent, or Firm*—Garrettson Ellis

[57] ABSTRACT

An electric light has a casing with a depth that is less than half as great as its width. This is rendered possible by the use of a compact, precision reflector which permits a focused, parallel-directed beam despite the configuration of the casing.

17 Claims, 3 Drawing Figures

COMPACT ELECTRIC LIGHT

BACKGROUND OF THE INVENTION

Nicholl, U.S. Pat. No. 3,395,272 discloses a generally conventional, elongated flashlight having an unusual reflector member, in which some of the reflector is forward of the light bulb, above and beyond the well-known parabolic reflector to the rear of the light bulb. Such a structure is alleged to provide better concentration of light, collimating more light, while allowing less light to scatter, which is a problem found in many lights with conventional reflectors.

In the field of electric lights, for example flashlights and the like, there are many situations where it would be desired for the flashlight to not be long and thin, as is typical, but short and wide. Such a light can fit into a campact compartment, or hang on the wall without projecting outwardly in an undue manner.

While attempts have been made on occasion to provide portable lights which are wider than they are long, this has generally required that the reflector be designed in a less than optimum configuration, so that light beams from such devices have a considerable amount of spread, and thus operate poorly for illuminating distant objects.

In accordance with this invention, an electric light is provided, combining the advantages of a very short length, while at the same time the parallel beam characteristic of collimation of the light emitted can be excellent for improved illumination of distant objects. Accordingly, the electric light of this invention may be used as a flashlight, an automobile headlight, a spotlight, an airplane landing light, or any of many other uses, while being in a configuration that is more convenient in many circumstances for carrying in the hand or installation in a bracket on the front of a vehicle, or the like.

DESCRIPTION OF THE INVENTION

An electric light is provided having a casing, a reflector, a light bulb, and power transmission means to provide illuminating power to the light bulb. In accordance with this invention the casing has a depth that is less than one-half as great as its width, the depth being measured generally parallel to the beam of light emitted by the electric light, and the width being measured substantially perpendicular thereto.

The reflector used in the electric light of this invention defines a first reflector member, with the light bulb projecting centrally and forwardly through the first reflector member. The reflector also defines a second reflector member positioned forward of the light bulb, the second reflector member comprising a light transmissive element defining reflector ring means. The first reflector member and reflector ring means are positioned to intercept most of the light emitted forwardly from the bulb and to direct it into a substantially parallel beam. In preferred embodiments, some of the light which is reflected generally rearwardly from the bulb may be captured and reflected in the substantially parallel beam as well. For example, electric lights manufactured in accordance with this invention are capable of directing into the substantially parallel beam essentially all of the light emitted by the light bulb in a spherical section defined by an arc of about at least 200 degrees and preferably about 220 degrees. This of course is a larger spherical section than a hemisphere, which is defined by an arc of 180 degrees.

The second reflector member is positioned generally forward of the light bulb. The first and second reflector members are positioned to intercept most of the light emitted forwardly from the bulb and to direct it into a substantially parallel beam.

In this invention, the second reflector member may define a lens in a central portion of the beam path, to focus centrally directed light into the same substantially parallel beam of light formed by the first reflector member and reflector ring means.

The second reflector member may also be adjustably movable relative to the light bulb along the direction of the light beam, for adjustable beam focusing. Thus, it becomes possible to adjust the beam for various manufacturing deviations. The beam may be optimized by adjustment after the electric light has left the factory.

As another inventive feature, the first reflector member may define an inner ring-shaped surface which is substantially flat and substantially parallel to the nearest paths of light emission from the light bulb. Thus, the light from the light bulb tends to graze across the inner ring-shaped surface.

Radially outwardly from the inner ring-shaped surface is an outer ring-shaped surface which surrounds the inner ring-shaped surface and has a generally parabolic, reflective surface to reflect light from the bulb into the substantially parallel beam. The inner ring-shaped surface may be tapered rearwardly as it extends outwardly from the light bulb, which makes it possible for the outer ring-shaped surface to extend the light collecting area beyond a simple hemisphere around the bulb. The spherical section of light collection may be on the order of 220 degrees, providing a higher percentage of light produced by the bulb to the beam than is provided in prior art configurations.

The second reflector member may be an integrally molded, transparent plastic sheet positioned to intercept the beam of light emitted by the electric light. The reflector ring means may project inwardly from the plastic sheet, while carrying a reflective surface coating to catch light and to direct it into the parallel light beam. The reflective surfaces of the reflector ring means may be parabolic and shaped to direct the light that it receives in a direction substantially parallel to the reflected light from the first reflector member.

Typically, efforts are made in the specific design of the reflector used in this invention to cause a maximum amount of the light emitted to either be reflected from the first reflector, or the reflector ring means, or passed through the lens. The various parts are preferably positioned so that all of the light emitted in a forward hemisphere from the bulb, and more, strikes either a reflective surface or the lens, and a bare minimum of light is thus absorbed by non-reflective or non-transmissive surfaces or allowed to scatter without collimation.

A folding handle may be carried on the side of the casing facing away fron the light beam-generating side of the casing. The handle is preferably foldable flush into the casing, and when the handle is folded away, it is preferred for the length of the casing and reflector to be no more than 2.5 inches, less than one third of the width of a preferred embodiment of electric light in accordance with this invention.

DESCRIPTION OF SPECIFIC EMBODIMENTS

Figure 2:
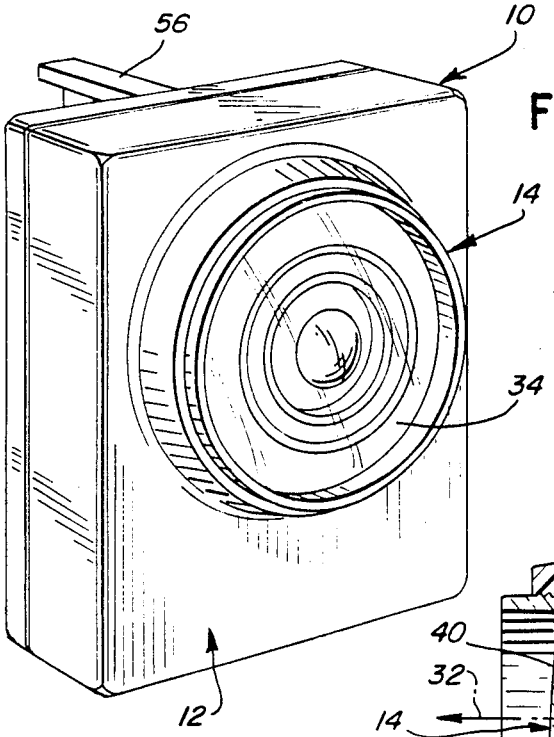
FIG. 2 is a front perspective view of the flashlight of FIG. 1.
Figure 1:
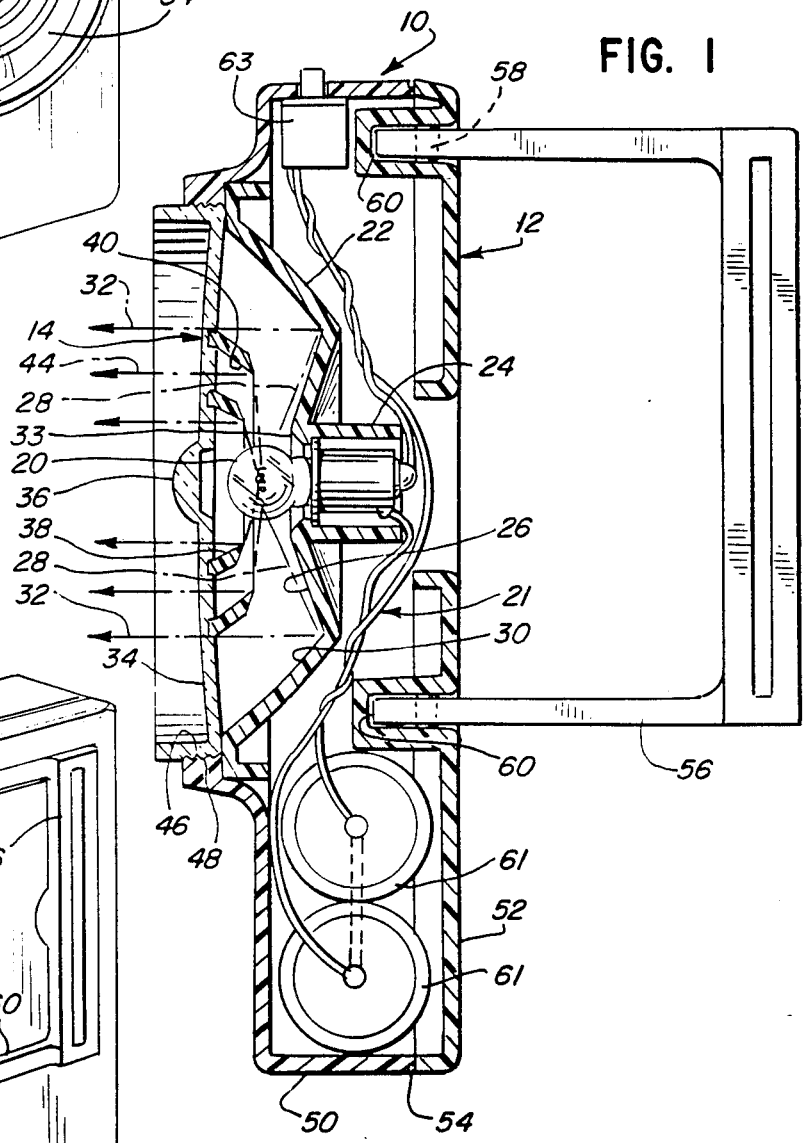
FIG. 1 is a transverse sectional view of a hand held flashlight made in accordance with this invention.
Figure 3:
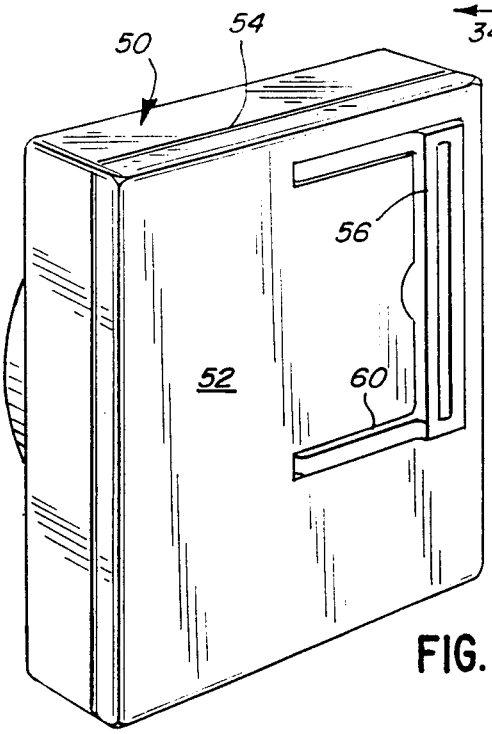
FIG. 3 is a rear perspective view of the flashlight of FIG. 1 with the rear handle in folded configuration.

A flashlight made in accordance with this invention is disclosed. Flashlight 10 defines a casing 12 which, contrary to normal usage, has a depth (i.e. the dimension of the casing parallel to the direction of propagation of the light beam) which is no more than one-half the width of the device. Specifically, the length of the casing at its largest dimension including reflector 14, may be 2 inches, while the two dimensions of width 16, 18, of casing 10 are, respectively, 4.9 inches and 6.2 inches, in this specific design.

Flashlight 10 carries a light bulb 20 and power transmission means 21 comprising wires and connectors for holding one or more batteries as a power source.

In conventional flashlights and other directional beam lamps, they have previously been made of very short length only at a substantial sacrifice to the quality of collimation of the light beam emitted by bulb 20 and reflector 14. This means that the beam spreads so as to fail to illuminate an object at a significant distance. Additionally, as another disadvantage, the dark center of the beam of conventional flashlights, using a single rear reflector, is relatively large.

By this invention, an advanced reflector is used in a casing of a very short length as shown to permit a high quality light beam to be cast from a light, despite the shortness of casing 10, greatly reducing the above disadvantages. Because of this, light 10 may be installed in confined spaces, hung on a wall, or simply more conveniently carried by the user, while at the same time, a light beam having high collimation can be emitted.

Reflector 14 comprises a first reflector member 22, through which light bulb 20 projects centrally and forwardly. As shown, first reflector member 22 defines a sleeve 24 into which bulb 20 can reside, with sleeve 24 typically constituting a conventional electric socket for communication of the bulb with the power transmission means 21.

Positioned about sleeve 24 is an inner, ring-shaped surface 26 which is shown to be substantially flat, positioned to the rear of the center of light bulb 20, and substantially parallel to the nearest paths of light from bulb 20 light, indicated by reference numeral 28. It can also be seen that inner, ring-shaped surface 26 extends rearwardly from the center of bulb 20 as shown. This provides additional light-collecting capability to the system, since more than a hemisphere of light emitted from light bulb 20 can be collected by reflector 14 by this expedient.

First reflector member 22 also defines an outer ring-shaped surface 30 surrounding and generally attached to inner ring-shaped surface 26. Outer ring-shaped or annular surface 30 is generally parabolic in shape and reflective, to reflect light from bulb 20 into a parallel beam as indicated by arrow 32. Annular reflector surface 33 is also provided between inner surface 26 and outer surface 30 to reflect light from bulb 20 into parallel beam 32.

Reflector 14 also carries second reflector member 34 which may generally be made of a molded piece of transparent plastic.

Second reflector 34 defines a lens 36 in a central portion of a beam path to focus centrally directed light into the parallel beam in the direction indicated by arrows 32. Also, second reflector member 34 carries a pair of reflector rings 38,40, which define generally parabolic forward-facing surfaces. They are positioned to intercept light (for example, beam 44) emitted by bulb 20 and to reflect it into the parallel, collimated light beam as exemplified by arrows 32. Together, first reflector member 22 and reflector rings 38,40 are positioned to intercept most of the light emitted forwardly from bulb 20 and to direct it to a substantially parallel beam. Additionally, lens 36 contributes more light to the parallel beam, while the rearward-tapering inner ring-shaped surface 26 permits outer ring-shaped surface 30 to reflect not only forwardly directed light but also some light which is directed completely sidewardly, and even some rearwardly directed light into the collimated beam exemplified by arrows 32.

Typically, because of the angle of inclination of inner, ring-shaped surface 26, it is possible by this invention to collect essentially all the light emitted by bulb 20 in a spherical section defined by an arc of at least 200 degrees, for example 220 degrees.

Second reflector member 34 also defines peripheral screw threads 46 which mate with corresponding threads 48 on the front wall of housing 10 as shown. Thus, second reflector member 34 can be rotated, to move inwardly or outwardly relative to bulb 20 and first reflector member 22. This will, of course, effect the collimation of the emitted light beam so that such may be optimized by the user at any time by adjustment. This makes it possible in effect to focus more light on objects at varying distances from the light, or simply to adjust the light beam, as may be desired.

Casing 12 defines a front portion 50 which may be a single molded piece of plastic, and a rear portion 52 which may enter into snap-fit relation with front portion 50 in conventional manner at annular junction area 54.

Rear wall 52 of casing 12 may carry a foldable handle 56 which is attached in pivotable relation by pins 58 positioned in U-shaped recess 60. Thus, handle 56 may be folded outwardly for easy holding, and folded inwardly for storage on a wall hanger or small compartment.

Reflector rings 38,40 may preferably be positioned completely forward of bulb 20.

Batteries 61 may be conventionally held in casing 12 and electrically connected to the base of light bulb 20. Switch 63 is provided to make and break electrical connection in a conventional manner.

In accordance with this invention, a compact electric light is provided of very short length to facilitate storage in a compact bracket, or the like, while at the same time the electric light of this invention can provide superior beam performance, and greater efficiency of operation, as a larger spherical section of light is focused into a collimated beam than in prior art.

The above has been offered for illustrative purposes only, and is not intended to limit the scope of the invention of this application, which is as defined in the claims below.

That which is claimed is:

1. In an electric light having a casing, a reflector, a light bulb, and power transmission means to provide illuminating power to the light bulb, the improvement comprising, in combination: said casing having a depth that is less than one-half as great as its width, said width being measured generally parallel to the beam of light emitted by said electric light, said reflector defining a first reflector member, said light bulb projecting centrally and forwardly through said first reflector member, said reflector also defining a second reflector member positioned forward of said light bulb, said second reflector member comprising a light transmissive element defining reflector ring means, said first reflector member and reflector ring means being positioned to intercept most of the light emitted forwardly from said bulb and to direct it into a substantially parallel beam.

2. The electric light of claim 1 in which said second reflector member defines a lens in a central portion of the beam path, to focus centrally directed light into said parallel beam.

3. The electric light of claim 1 in which said second reflector member is adjustably movable relative to said light bulb along the direction of said beam for adjustable beam focusing.

4. The electric light of claim 1 in which said first reflector member defines an inner, ring-shaped surface which is substantially flat, positioned to the rear of the center of said light bulb, and substantially parallel to the nearest paths of light emission from said light bulb, and an outer ring-shaped surface surrounding said inner ring-shaped surface and having a generally parabolic, reflective surface to reflect light from said bulb into said substantially parallel beam.

5. The electric light of claim 1 in which said reflector is capable of directing into said substantially parallel beam essentially all of the light emitted by said light bulb in a spherical section defined by an arc of at least 200 degrees.

6. The electric light of claim 2 in which a folding handle is carried on the side of said casing facing away from said substantially parallel beam.

7. The electric light of claim 6 in which the depth of said casing and reflector is no more than 2.5 inches when said handle is folded.

8. The electric light of claim 1 in which said second reflector is an integrally molded, transparent plastic sheet positioned to intercept said beam of light emitted by the electric light, said reflector ring means projecting inwardly from said plastic sheet and carrying a reflective surface coating.

9. The electric light of claim 8 in which said reflector ring means is positioned completely forward of the light bulb.

10. In an electric light having a casing, a reflector, a light bulb, and power transmission means to provide illuminating power to the light bulb, the improvement comprising, in combination:

said casing having a depth that is less than one-half as great as its width, said depth being measured generally parallel to the beam of light emitted by said electric light, said reflector defining a first reflector member, said light bulb projecting centrally and forwardly through said first reflector member, said reflector also defining a second reflector member positioned forward of said light bulb, said second reflector member comprising a light transmissive element defining reflector ring means, said first reflector member and reflector ring means being positioned to intercept most of the light emitted forwardly from said bulb and to direct it into a substantially parallel beam; said second reflector member being adjustably movable relative to said light bulb along the direction of said beam for adjustable beam focusing; said first reflector member defining an inner ring-shaped surface which is substantially flat and substantially parallel to the nearest paths of light emission from said light bulb, said first reflector member also defining an outer ring-shaped surface surrounding said inner ring-shaped surface and having a generally parabolic, reflective surface to reflect the light from said bulb into said substantially parallel beams.

11. The electric light of claim 10 in which said second reflector member is an integrally molded, transparent plastic sheet positioned to intercept said beam of light emitted by the electric light, said reflector ring means projecting inwardly from said plastic sheet and carrying a reflective coating.

12. The electric light of claim 11 in which a folding handle is carried on the side of said casing facing away from said substantially parallel beam.

13. The electric light of claim 12 in which said reflector is capable of directing into said substantially parallel beam essentially all of the light emitted by said light bulb in a spherical section defined by an arc of at least 200 degrees.

14. The electric light of claim 13 in which the length of said casing and reflector is mo more than 2.5 inches when said handle is folded.

15. The electric light of claim 14 in which said second reflector member defines a lens in a central portion of the beam path to focus centrally directed light into said substantially parallel beam.

16. The electric light of claim 15 in which said reflector ring means is positioned completely forward of the light bulb.

17. The electric light of claim 16 in which said reflector ring means includes a pair of spaced, concentric reflector rings, said reflector rings defining generally parabolic reflecting surfaces.

* * * * *